US007374215B2

(12) United States Patent
Anderson

(10) Patent No.: US 7,374,215 B2
(45) Date of Patent: May 20, 2008

(54) "SCOOPEEZE" PORTABLE CANINE WASTE PICK-UP DEVICE

(75) Inventor: Bruce Warren Anderson, Omaha, NE (US)

(73) Assignee: Scoopeeze Brands, LLC, Omaha, NE (US)

( * ) Notice: Subject to any disclaimer, the term of this patent is extended or adjusted under 35 U.S.C. 154(b) by 0 days.

(21) Appl. No.: 11/039,280

(22) Filed: Jan. 20, 2005

(65) Prior Publication Data

US 2006/0157994 A1 Jul. 20, 2006

(51) Int. Cl.
*A01K 29/00* (2006.01)
*E01H 1/12* (2006.01)

(52) U.S. Cl. ..... 294/1.3

(58) Field of Classification Search ..... 294/1.1, 294/1.3, 1.4, 55; 15/257.1, 257.6, 104.8, 15/257

See application file for complete search history.

(56) References Cited

U.S. PATENT DOCUMENTS 2,141,007 A * 12/1938 Meeh ..... 294/55
3,052,214 A * 9/1962 Johnson ..... 294/1.4
3,139,299 A * 6/1964 Bowen ..... 294/1.4
3,281,178 A * 10/1966 Fisher ..... 294/1.4
3,286,826 A * 11/1966 Stoll ..... 294/1.3
3,431,008 A * 3/1969 Narita ..... 294/1.4
3,446,525 A * 5/1969 Jones ..... 294/1.4
3,560,039 A * 2/1971 Gruber ..... 294/1.3
3,606,436 A * 9/1971 Lynch ..... 294/1.4
3,659,891 A * 5/1972 Pettenon et al. ..... 294/1.4
3,676,887 A * 7/1972 Klein ..... 294/1.3
3,716,263 A * 2/1973 Gatti ..... 294/1.4
3,757,737 A * 9/1973 Drum et al. ..... 294/1.4
3,778,097 A * 12/1973 Dorzan ..... 294/1.4
3,786,780 A * 1/1974 Pezzino ..... 294/1.5
3,804,448 A * 4/1974 Schmieler ..... 294/1.4
3,813,121 A * 5/1974 Marvin ..... 294/1.3
3,819,220 A * 6/1974 Bredt ..... 294/1.5
4,019,768 A * 4/1977 Niece ..... 294/1.3
4,215,887 A * 8/1980 Boots ..... 294/1.4
4,323,272 A * 4/1982 Fortier ..... 294/1.4
4,341,410 A * 7/1982 Summach ..... 294/1.3
5,540,469 A * 7/1996 Albert ..... 294/1.4
6,039,370 A * 3/2000 Dooley et al. ..... 294/1.5
6,237,972 B1 * 5/2001 Jung ..... 294/1.4
6,554,335 B1 * 4/2003 Kelly et al. ..... 294/15
6,986,325 B1 * 1/2006 Hsu ..... 119/867

* cited by examiner

*Primary Examiner*—Dean J Kramer
(74) *Attorney, Agent, or Firm*—Suiter Swantz pc llo

(57) ABSTRACT

A device for collecting, transporting, and disposing of waste material comprising a handle and a body coupled to the handle further comprising an outer semi-circular frame having an inner cavity, a semi-circular insert inserted into the outer semi-circular frame, and a liner inserted into the semi-circular insert. The inner semi-circular insert rotates within the inner cavity of the outer semi-circular frame and the semi-circular insert further comprises a graspable protrusion coupled to a lateral surface of the semi-circular insert.

14 Claims, 7 Drawing Sheets

"SCOOPEEZE" PORTABLE CANINE WASTE PICK-UP DEVICE

CROSS-REFERNCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF INVENTION

1. Field of the Invention

The field of invention to which this invention relates is the collection of animal solid waste. More specifically, this invention constitutes a device or system that integrates into common leashing systems and will be used by dog owners to clean up their dog's solid waste material while walking their dog. The design of this invention allows the pet owner to easily and quickly pick up the waste material, contain it in a sanitary, inexpensive, disposable bio-degradable container to carry the waste and discretely transport it, without having to carry an additional device in ones free hand, or further encumbering the leash hand, until it can be disposed of properly. Other products or prior art provide ways to carry plastic bags conveniently before use or in other cases provide a means to make "collecting" the waste material easier but none provide the pre-use convenience, speed, and a means to carry the waste after collection with out using ones free hand (non leash hand) or without further encumbering the leash hand in a discrete manner until disposal.

This invention, allows the dog owner to pick up the waste more quickly than other products usually less than 5 seconds start to finish, the owner does not have to make tactile connection with the waste, nor will the waste make contact with non-disposable areas of the devise, the disposable liner is biodegradable, and the waste is contained discretely within the device which is part of the leash system thereby alleviating the need to carry the waste in ones free hand or further encumber the hand holding the leash.

With 45 million dog owners and 65 million dogs in the United States alone, cleaning up dog waste can be a major problem in many urban and suburban areas in the U.S. and other cities around the world. Today in many cities it is mandatory, in others it is requested. In all cases, the easier and less offensive the process of waste pick up is, the more people will act responsibly in cleaning up after their pet in an environmentally friendly way.

2. Description of Prior Art

The following patents illustrate various prior art devices and methods of collecting pet waste:

U.S. Pat. No. 6,554,335 describes a pet waste collection system, which includes a main housing having a hollow inside and having a top, a bottom, a front, and a back and at least one sidewall, and having an opening accessible to the hollow inside area. There is also a telescopically extendable and contractible pole attached at a first end to the hollow inside area of the main housing and attached to a collapsible frame at its second end. The collapsible frame unfolds for a waste receptacle, i.e. a "pooper" bag, and is spaced behind the pet during defecation. In some embodiments, an attachment hook is located on said main housing for attachment thereof to a leash, a belt, or other attachable area or item.

U.S. Pat. No. 2,141,007 describes a shovel comprising walls forming an enclosure open at one end and closed at the opposite end, a sleeve rigid with the closed end of the shovel angularly and rearwardly therefrom, a pair of longitudinally spaced flanges integral with said sleeve, a collar rotatably mounted around the sleeve between said flanges and held from longitudinal movement thereby, a handle extending into and rigidly attached to said sleeve and projecting upwardly and rearwardly therefrom, and a rotary sleeve mounted on the outer end of said handle approximately at right angles to said first named sleeve and facilitating turning of the shovel to extend the open end thereof downwardly and discharge the contents therefrom.

U.S. Pat. No. 3,052,214 describes a disposable catcher for trapping and containing excrement and the like for disposal thereof, said catcher comprising, in combination, a bag holding and operating means comprising a stick, said stick comprising connecting rod and a connecting tubular rod holder disposed therearound to limit movement of said rod between a forward lid open and a rearward lid closed position, and a disposable bag readily detachably connected to said stick, said bag comprising a disposable bag body and a movable lid, said lid being readily detachably connected to said connecting rod and said bag body being detachably connected in supporting position to said connecting rod holder, whereby said lid can be moved to open and closed positions by movement of said connecting rod, said bag being readily detached from said stick by detachment of said lid and said bag body from said connecting rod and connecting rod holder, respectively.

U.S. Pat. No. 3,139,299 describes a refuse collector, comprising in combination: an elongated and vertically extending tube element, said tube having an outlet at the bottom thereof; an elongated element in longitudinal sliding in relationship and by the tube element, one of said elements being rigid and having a handle section for manipulating the collector; a bowl carried by and at the lower end of one of said elements; a scoop for the bowl; means for pivotally connecting the scoop to both of said elements; means coupling the upper end of the tube with a source of fluid; and a manually actuated valve carried by the tube for controlling the flow of liquid through the tube.

U.S. Pat. No. 3,281,178 describes a device for collecting and disposing of animal fecal matter, comprising, in combination, a handle, a first frame element, a second frame element, one end portion of said first frame element being spaced apart from and oppositely positioned with respect to one end portion of said second frame element, the other end portion of said first frame element being connected to said second frame element, said handle member being transversely positioned with respect to both said first frame element and second frame element and being connected to said connected first and second frame elements, and a bag member removably attached to said connected first and second frame elements at their respective one end portions spaced apart from and oppositely positioned with respect to each other, said bag member having a collar and a body portion integral with said collar, said collar being sealed to said body portion at least two opposite points thereof, each of said two opposite points being between said two spaced apart and oppositely positioned end portions of said first and second frame elements, said collar being positioned over said two spaced apart and oppositely positioned end portions of said first and second frame elements, said body portion being positioned between said first and second frame elements, whereby said device can be easily used without any fecal matter to be collected contacting the frame elements and whereby said bag member can be easily removed and then closed and sealed by raising and inverting one side of said collar.

U.S. Pat. No. 3,286,826 describes a portable combination flat package for use in removing dog refuse from an area in which it is deposited including: a flexible fibrous container in the form of a sack having an open end that is defined by first and second flat side walls, two end walls and a bottom, with said end walls and bottom having centrally disposed fold lines formed therein that extend the length thereof, and said first side wall includes as an integral part thereof an extension that projects beyond said open end, which container is selectively disposable in either a first position in which it is flattened, a second positioned in which it is expanded to receive dog refuse through said open end when said extension is placed in contact with the surface on which said refuse rests, and a third position in which said container is rolled upon itself with said refuse within the confines thereof, with said extension when said container is in said third position being wrapped thereabout to seal the same; a rectangular sheet of cardboard of substantial stiffness disposed within said container when in said first position to prevent lateral creasing of said container, which sheet has a plurality of spaced fold lines formed therein that extend longitudinally and transversely therein which aid in shaping said sheet into a scoop when said sheet is removed from said container, and when said sheet is so shaped it defines two parallel longitudinally extending flanged that act as stiffeners, in the use of said scoop to pick up refuse and deposit the same together with said sheet in said container when in said second position; and, tie means within said container in said third position for holding said container in said third position with said refuse and sheet within the confines thereof with said extension being wrapped around said container to seal the same.

U.S. Pat. No. 3,431,008 describes a portable scavenging apparatus for removing feces of animals and other untouchable objects comprising a box having an opening therein and a lid adapted to selectively close and open said opening, a stick having a first end mounted to a wall of said box, means for moving said lid selectively between its closed and open positions including a lever, a link, an arm, and a spring, said lever being pivotally mounted at a predetermined point intermediate its ends to said stick at a predetermined point adjacent the second end of said stick, a handle mounted in fixed position to said stick to provide a stationary member toward which one end of said lever may be manually pivoted, said spring being interposed between said handle and said lever to normally urge said one end of said lever away from said handle, said link being attached to the opposite end of said lever so as not to be moved away from said handle when said lever is manually pivoted toward said handle, said link being mounted to said arm and said arm being operative when said lever and said link are moved to move said lid between its closed and open positions.

U.S. Pat. No. 3,446,525 describes in a portable pickup device for grasping and transporting unclean material such as animal droppings and the like, said device having an elongated body provided with a handle at one end: pickup means carried at the other end of the body including a pair of pickup members in virtually parallel planes, said pair of pickup members including parallel bottom straight portions cooperable to move along a surface in close relation thereto whereby at least one straight portion is adapted to move beneath a dropping to be picked up, at least one of said pickup members being an open frame; means for moving at least one of the pickup members to and away from the other; and a disposable compliant wrapping means received and held on said pickup means with an opening at said bottom portions, the open frame pickup member being adapted to permit outward lateral displacement of said compliant wrapping means when a dropping is lifted by said straight portions of the pickup means for containing the dropping in said wrapping means at one side of the pickup means.

U.S. Pat. No. 3,560,039 describes an apparatus for handling and disposing of animal excrement and the like comprising in combination a tong member including a pair of levers pivotally connected together intermediate their ends, loop handle portions at one end of each of said levers, the other end of each of said levers having a transverse elongated scoop portion which curves concavely inwardly toward the opposite lever whereby said scoop portions form a closed-end scoop when said long end member is in the closed position, and tissue-retaining means on said tong member for retaining a package of tissues therein, said tissue retaining means including a receptacle connected to one of said pair of levers and a removable cover on said receptacle having an opening therein for the removal of tissues from said receptacle.

U.S. Pat. No. 3,606,436 describes a portable device for picking up objects underfoot comprising: a first assemblage including a first blade-like member secured to the lower end of a first operating rod and projecting angularly therefrom; a second assemblage including a second blade-like member secured to the lower end of a second operating rod and projecting angularly therefrom; hinging means pivotally interconnecting said first and second assemblages for pincers-like movement of said blade-like members upon manipulation of said operating rods; and, a bag having a portion of its open end detachably secured to said first blade-like member, another portion of its open end detachably secured to said second blade-like member, and a portion of its closed end detachably secured to one of said operating rods so that the inverted bag is selectively opened and closed by the pinchers-like movement of said blade-like members resulting from manipulation of said operating rods.

U.S. Pat. No. 3,659,891 describes a refuse collecting device having an improved tubular bag-mounting member at the lower end of a handle for collecting refuse such as animal leavings and the like. The refuse is collected in a disposable bag removably mounted on the tubular element in an improved manner for positive association with the tubular element during use while yet providing for facilitated withdrawal of the bagged matter in a sanitary manner.

U.S. Pat. No. 3,676,887 describes a flexible bag body portion that has a substantially rigid blade element permanently attached to one side wall thereof adjacent the open mouth of the bag body portion. A flexible closure flap is carried by the opposite side wall of the bag body portion and has an adhesive sealing area coact with a like area on the side wall of the body portion carrying the blade element. The bag is sealed with the litter and the blade element therein prior to disposal.

U.S. Pat. No. 3,716,263 describes a device for collecting articles and substances, comprising in combination: a handle; an adjustable shaft surmounted by said handle; a pair of outwardly inclined arms depending from said adjustable shaft; pivotal means depending from said arms; said pivotal means being normally maintained in an inclined, open position by spring means depending from said arms; said pivotable means being disposable into a horizontal, closed position when said pivotable means are in abutment with a surface and said handle is depressed; descendable means depending from said arms and contactable with said pivotable means when it is in said closed position, thereby obstructing the return of said pivotable means from said closed to said open position.

U.S. Pat. No. 3,757,737 describes a mechanical device for sequentially loading multiple bodies of animal dropping from the ground in to a disposable bag. The illustrated device has an elongated handle which carries a pickup means at its lower end. The pickup means includes means for releasably holding a bag with the mouth of the bag held open in a generally vertical plane, and a movable paddle proportioned and arranged to engage and propel a body of animal droppings into the bag through the open mouth. The movement of the paddle is remotely controlled from the upper end of the handle by a manually movable lever which is operable to impart a rapid propelling movement to the paddle.

U.S. Pat. No. 3,778,097 describes a device for retrieving litter that has manually actuated positioning means connected to a litter receptacle holder and a pushing member adapted to be enclosed in an envelope releasably secured about the pushing member. Actuation of the positioning means causes coaction between a litter receptacle mounted in the litter receptacle holder and the enveloped pushing member, so that litter is forced into the litter receptacle and held in the litter receptacle by the pushing surface. While the litter is being held within the litter receptacle by the enveloped pushing member, the envelope is released from about the pushing member and reversed to envelope the opening of the litter receptacle. The litter receptacle can then be manually ejected into the envelope when the positioning means are actuated to move the pushing member away from the litter receptacle.

U.S. Pat. No. 3,786,780 describes a portable canine toilet, in combination a holder and disposable waste receiving means adapted to be removably fitted upon the holder. The holder has a projecting means mounted on its rod portion, and the receiving means has a partially circumferential sleeve along its upper portion and into which the lower part of the holder is inserted. The receiving means also has a stringed collar at the top of the upper portion, the protruding portion of the string normally positioned on the projecting means.

U.S. Pat. No. 3,804,448 describes an elongated light weight shaft that has at one end a handgrip portion and at the other end a scavenging scoop receptacle with an inlet opening facing transversely of the length of the shaft. An electric light on or near the handgrip portion illuminates the receptacle inlet and the locale adjacent thereto. The implement may be manipulated by one hand of a user while the user is standing in his normal upright position. The scoop receptacle may include, or support, a detachable disposable container or liner. A closure lid is hingedly mounted relative to the scoop receptacle so that the lid can be moved into an open position while the receptacle is in scooping position and into closed position upon completion of the scooping operation, selectively, by manipulation of the shaft by the supporting hand of user. A pusher tool or brush is carried by the shaft near the receptacle. Propelling means are provided in the receptacle and are operable manually to propel the material scooped into the entry of the receptacle farther into the receptacle and away from the inlet opening so that the material can be carried in the receptacle without danger of spillage even with the shaft carried substantially upright.

U.S. Pat. No. 3,819,220 describes a sanitary device for pets which comprises a wand having at one end a pair of spring arms which normally are biased apart. A disposable receptacle having sleeve portions around its normally open top has such portions fitted on said arms to be held open thereby and positioned beneath a pet to receive feces as the latter is discharged. The receptacle is fitted on the arms; the arms squeezed together, the receptacle wrapped around the arms and a sleeve telescoped on the wand to retain the device in readiness. After use, the receptacle may be expelled from the arms by extending the sleeve.

U.S. Pat. No. 4,019,768 describes a device for sanitary pickup of ground deposited excrement comprises a metal frame structure having an excrement engaging pickup portion and a conventional bag supporting portion. Said bag holding portion positively retains a conventional shopping bag on the holding portion in a manner to hold the mouth of the bag open for ready reception of the said excrement together with additional structure supported by the handle for quick and easy release of said bag from positive retention on the support portion. Additional covers are also provided for the excrement engaging portion of the device to increase the usefulness of said device.

U.S. Pat. No. 4,215,887 describes a pickup device of highly functional yet inexpensive construction, comprising a pair of loop-shaped portions that are hinged together, with the loop-shaped portions being movable to a widely separated position such that an inverted bag that has been partially turned inside out may be inserted between the loops. Handle portions located above the hinge locations are able to be grasped by the user and brought together, with such action serving to bring base portions of the loops, as well as certain neck portions of the bag together. This action makes the device readily adaptable for the picking up of material from a floor or sidewalk, such as that deposited by an animal, with this arrangement advantageously serving to cause the removed material to be enveloped in the bottom portion of the bag, with the upper portions of the bag thereafter being easily brought together and tied, and with the exterior of the bag and the pickup device remaining unsoiled throughout the entire procedure.

U.S. Pat. No. 4,323,272 describes a hand portable and single hand operable device for picking up animal excrement and the like comprised of a pair of metal rods fixed close enough together at one end as V shaped extensions from a spring loop to form a handle portion for grasping with one hand about both rods which are deflectable toward each other by pressure of the hand. At the other end of each of the rods is a bag support member comprised of an elongated bag support wire loop formation having two substantially parallel width portions and two opposed length portions with length portions farthest from the handle portion in each bag support loop formation being straight and parallel to each other and moveable toward each other into line contact with each other by deflection of the rods. A bag having flexible sidewalls and an opening with a cuff is mounted on the respective bag support wire loop formation in a manner that the opening is at and controlled by the parallel straight portions of the bag support loop formations.

U.S. Pat. No. 4,341,410 describes a frame that comprises a handle and a pair of legs extending therefrom with the handle being substantially U-shaped and having a taut wire spanning the distal ends of the legs. A plastic or paper bag is engaged between the legs with one side of the open end folded over the taut wire and the legs and the forefinger of the hand holding the handle engaging the other side of the open end and tensioning the same against the wire. This holds the bag in the open position. The primary use is for scooping up waste material from animals such as dogs but it can also be used to hold a bag upright in the open position with one hand so that the bag can be filled with material by the other hand. It can also be used in industry for sanitary sampling of granular, comminuted, or liquid materials. In one embodiment the frame is foldable for easy storage.

U.S. Pat. No. 6,039,370 describes a portable pet toilet having an elongated pole having first and second ends. The first end provides a handle. Securely mounted on the second end of the pole is a pair of selectively adjustable arms for supporting a disposable receptacle. The arms are adjustable in order to provide the capability of accommodating receptacles of different sizes and shape.

Notwithstanding the prior art, the present invention is neither taught nor rendered obvious thereby.

BRIEF SUMMARY OF THE INVENTION

The Portable Canine Waste pick-up device consists of 4 parts, 1.) The detachable Handle 2.) The Outer semi-circular frame 3.) The Inner semi-circle insert(s) 4.) The liner with extended flap.

Scoopeeze© Portable Canine Waste pick-up device is made of one plastic, Nylon, or other synthetic materials, outer semi-circle and one or two polypropolene concentric inner semi-circular inserts, and disposable, opaque, bio-degradeable plastic, or other synthetic or composite material liners, and a detachable positive connect handle that provide a highly portable, clean, non tactile way to pick up canine waste while on a walk with a dog.

The Scoopeeze© Portable Canine Waste pick-up device integrates its form and function with traditional leashes by utilizing a metal clip through the eyelet in the handle or with commonly used retractable leashes by removing the handle and connecting the retractable leash to the docking feature on the outer semi-circle of Scoopeeze©.

The problems associated with other means of picking up canine waste material are that they are awkward to prepare for use, or they require the pet owner to use their hand to pick up the waste, or they require the pet owner to carry a bag of waste exposed to the public until they find a suitable trash recepticle, or they require carrying an additional device not integrated into the pet leashing system.

By it's design Scoopeeze© allows the pet owner to very quickly, usually less than 5 seconds, prepare, contain and cover solid dog waste in an opaque biodegradable disposable container which remains out of sight as part of the leash system, requiring only one hand, until a suitable trash receptacle is located.

DETAILED DESCRIPTION OF THE INVENTION

Figure 1A:
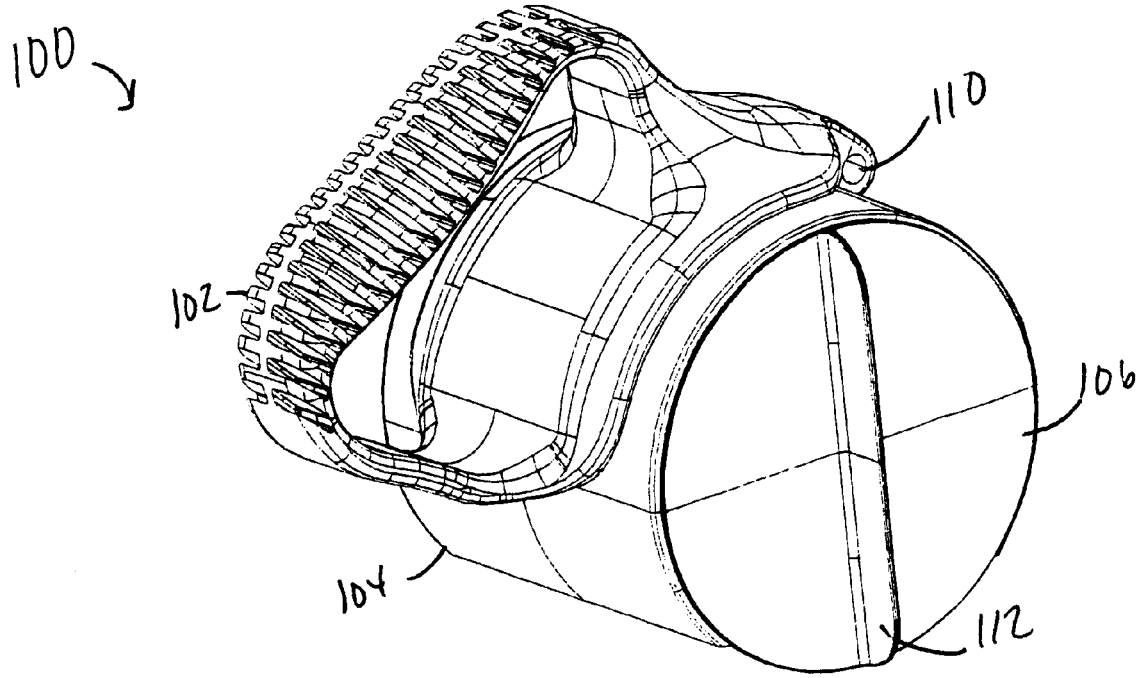
FIGS. 1A and 1B are isometric illustrations of a Portable Canine Waste Pick Up Device.
Figure 1B:
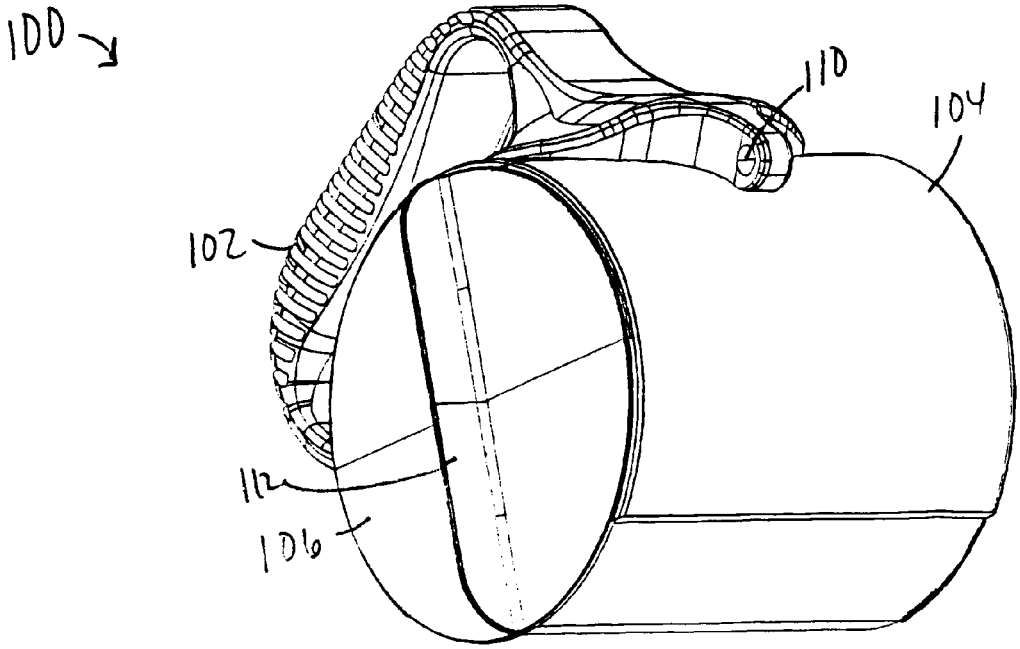
Figure 2A:
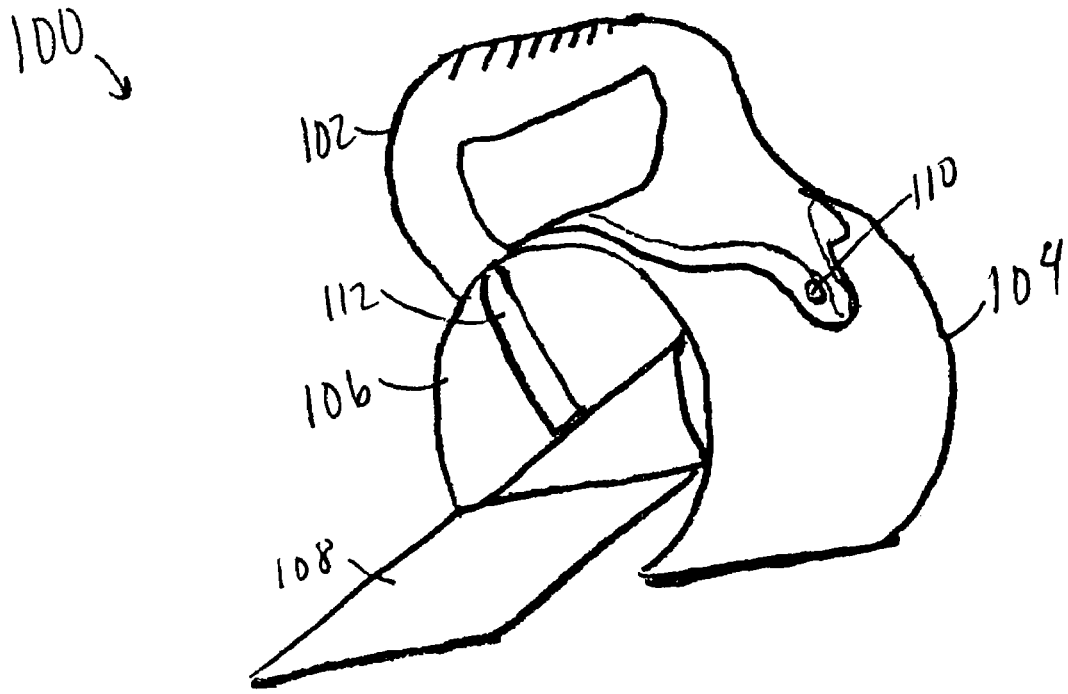
FIGS. 2A and 2B are additional isometric illustrations of a Portable Canine Waste Pick Up Device.
Figure 2B:
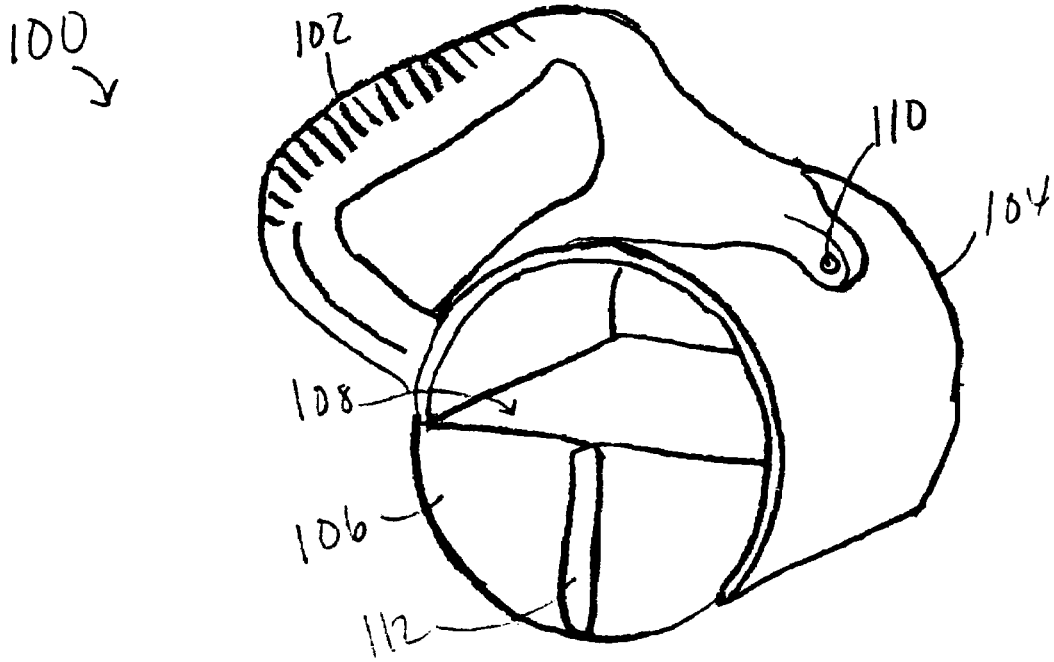
Figure 3:
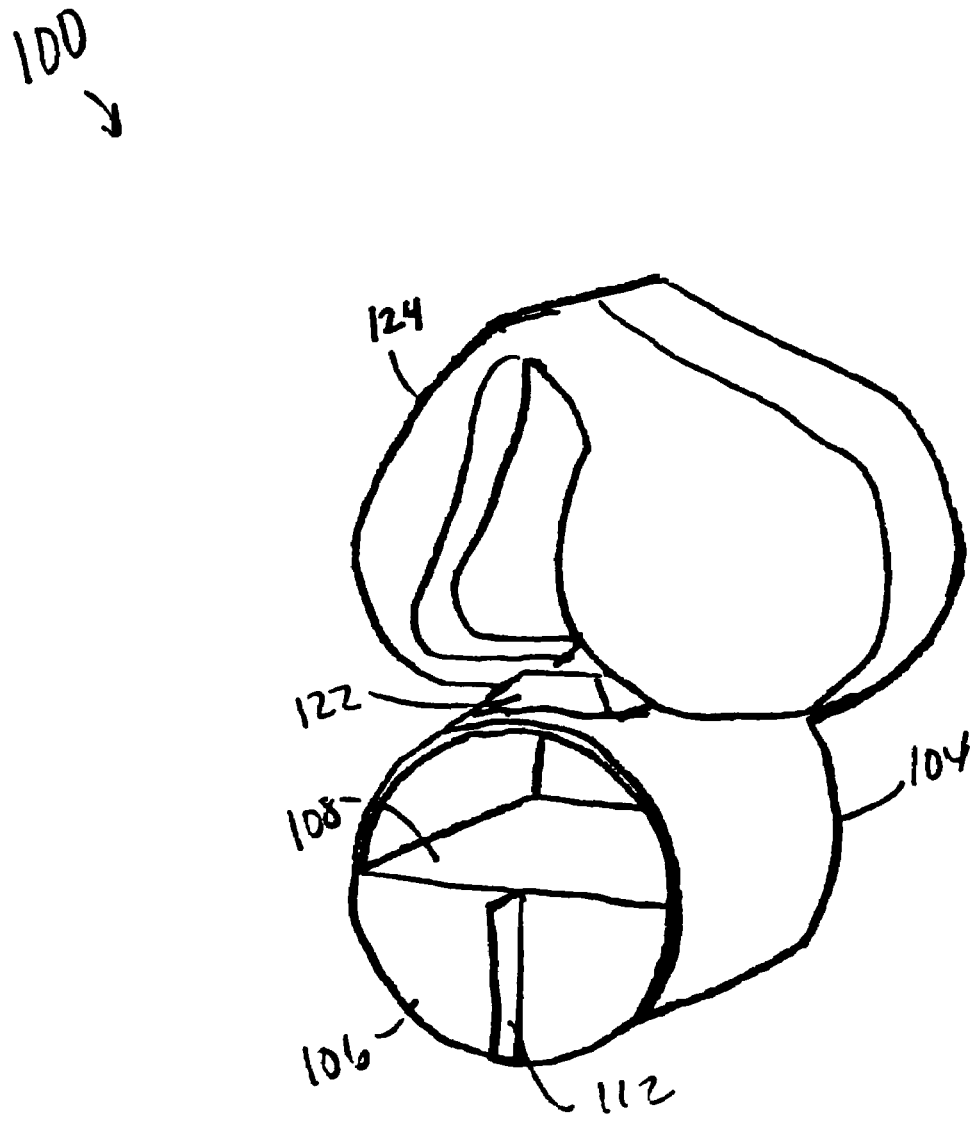
FIG. 3 is an isometric illustration of a Portable Canine Waste Pick Up Device docked with a retractable leash.
Figure 4:
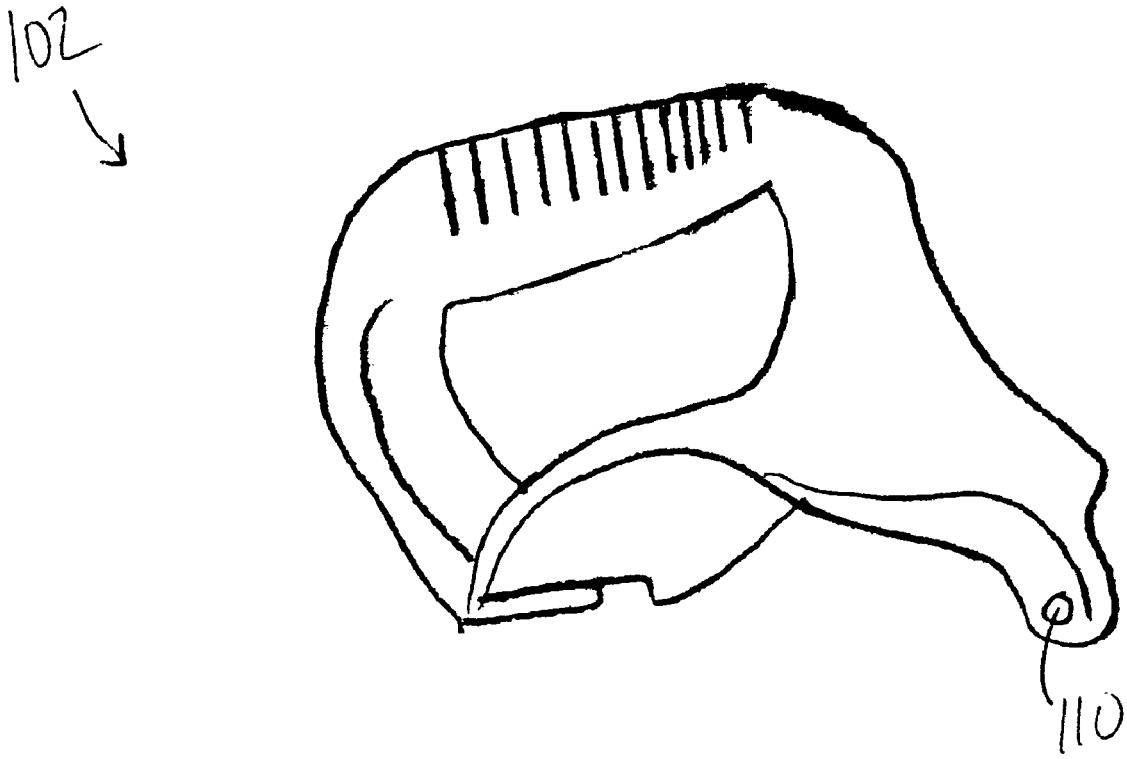
FIG. 4 is an isometric illustration of a Portable Canine Waste Pick Up Device detachable handle with eyelet for a metal ring.
Figure 5:
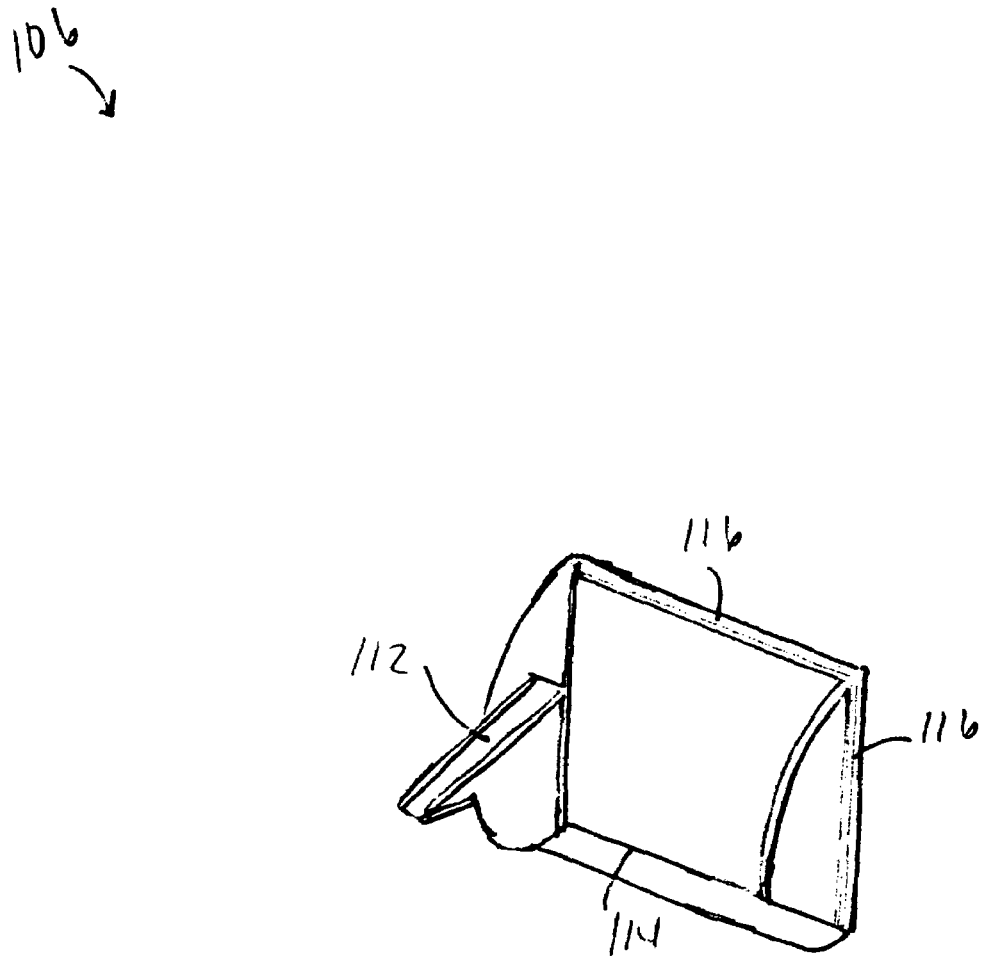
FIG. 5 is an isometric illustration of a Portable Canine Waste Pick Up Device inner semi-circle insert.
Figure 6:
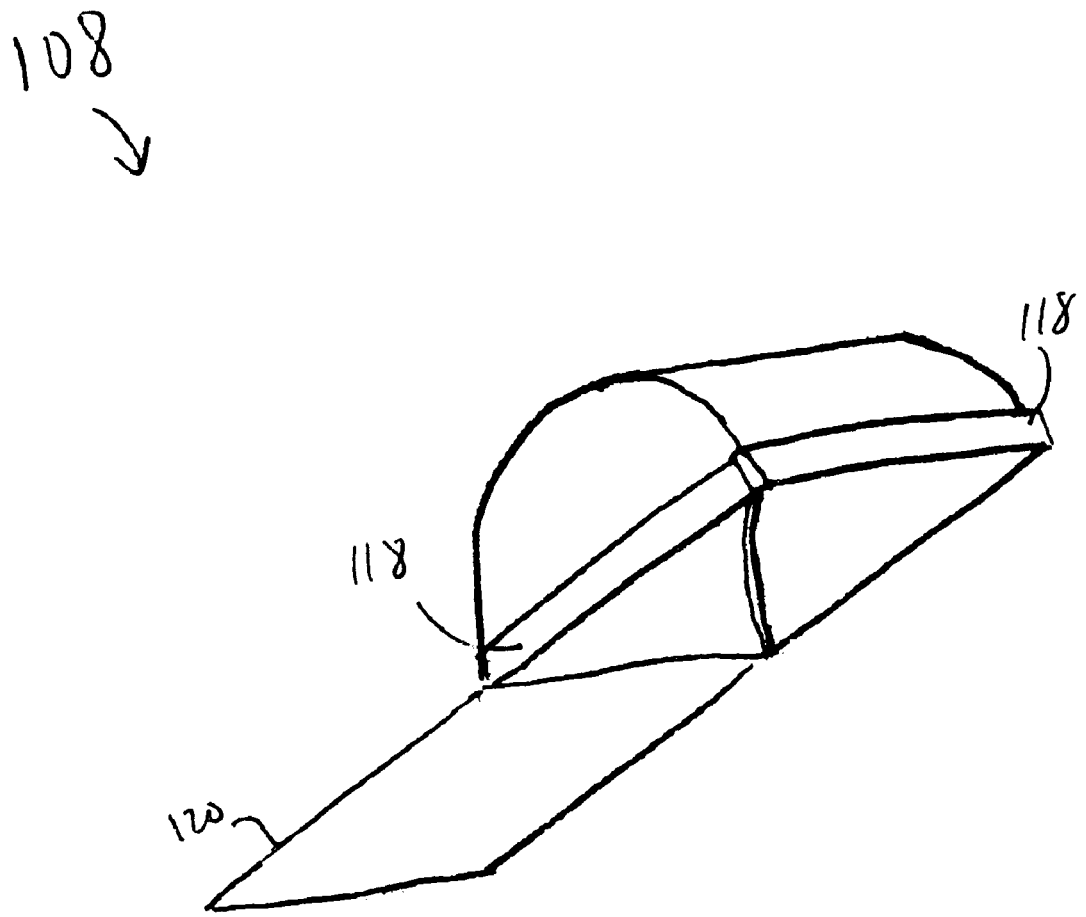
FIG. 6 is an isometric illustration of a Portable Canine Waste Pick Up Device liner and flexible sheet.
Figure 7:
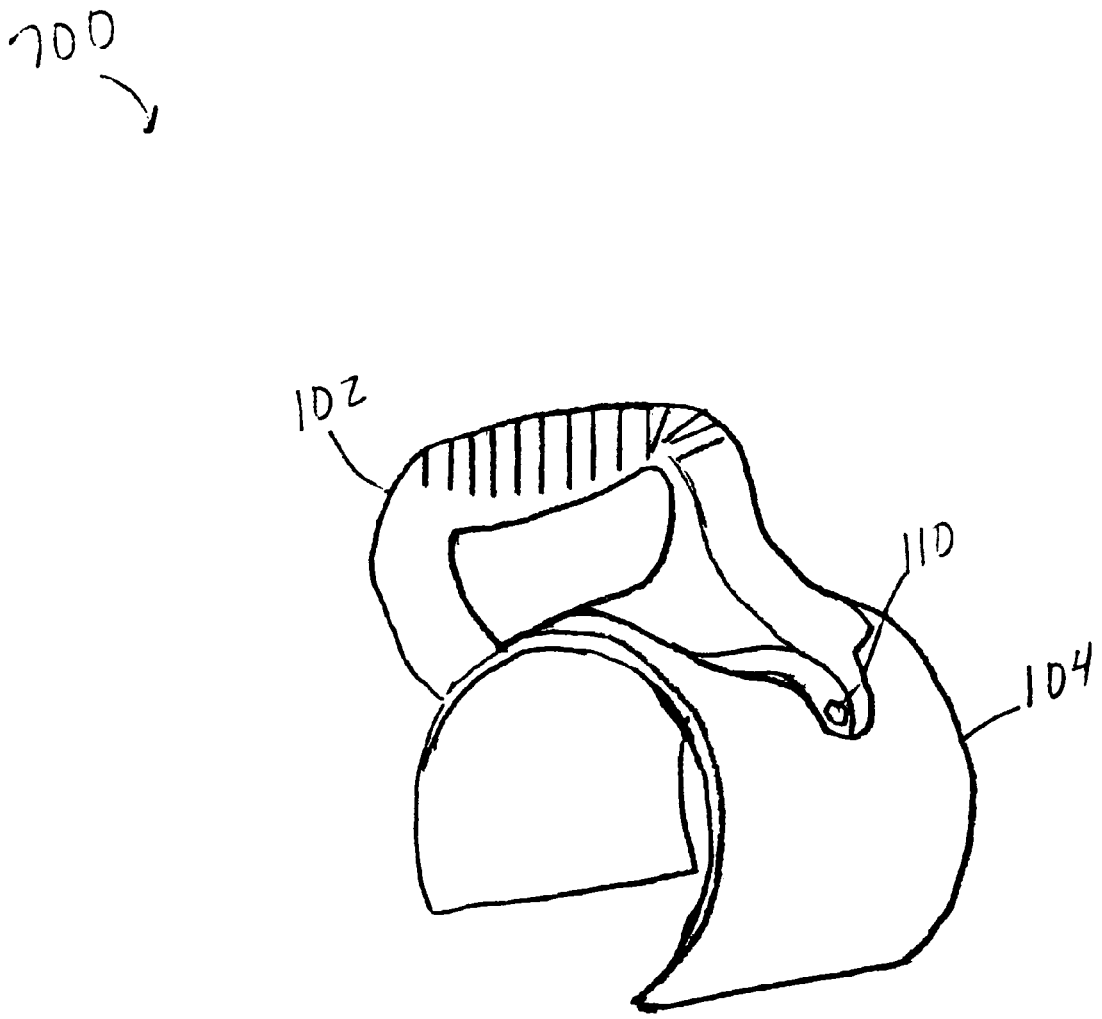
FIG. 7 is an isometric illustration of a Portable Canine Waste Pick Up Device detachable handle docked with outer semi-circle.

Referring generally to FIGS. 1-7, a portable canine waste pickup device 100 according to an exemplary embodiment of the present invention is shown. The Portable Canine Waste pick-up device 100 comprises 4 parts: 1.) The detachable handle 102 made by injection molding ABS or nylon. 2.) The Outer semi-circular frame 104 made by injection molding ABS or Nylon. 3.) The Inner semi-circle insert(s) 106 made by injection molding polypropylene or other synthetics. 4.) The liner 108 made by vacuum forming biodegradable plastic or other bio-degradable material.

Scoopeeze© Portable Canine Waste pick-up device is made of one plastic, Nylon, or other synthetic materials, outer semi-circle and one or more concentric inner semi-circular inserts disposable, bio-degradeable plastic, or other synthetic or composite material liners, and a detachable positive connect handle that provide a highly portable, clean, non tactile, discrete way to pick up canine waste while on a walk with a dog.

The Portable Canine Waste pickup device 100 integrates its form and function with traditional leashes by utilizing a metal clip through the eyelet 110 in the handle 102 or with commonly used retractable leashes 124 by removing the handle 102 and connecting the retractable leash 124 to the docking feature 122 on the outer semi-circular frame 104.

The outer semi-circle is made of a heavy gauge, approximately ⅛-¼ inch thick, plastic, Nylon, or composite, or other synthetic material that forms approximately a 315 degree concave arc that is open on both ends. The diameter of the arc and the width of the "SCOOPEEZE"© elements (outer semi-circle, inner semi-circle insert inserts and liners) change for small, medium, or large size dogs. The approximate sizes are:

| | | |
|---|---|---|
| Small | Dia = 3 inches | Width = 3 inches |
| Medium | Dia = 4 inches | Width = 4 inches |
| Large | Dia = 7 inches | Width = 7 inches |

The outer semi-circle has a detachable handle that attaches to the upper area of the outer semi-circle. The detachable handle contains an eyelet at the forward end that allows a metal ring for attaching the handle of a normal non-retracting leash. When attached to a standard leash the detachable handle provides a more comfortable and solid griping surface. When the detachable handle is removed it reveals that the outer semi-circle of "Scoopeeze"© has a molded docking unit which allows the connection of any third party retractable leash to the upper area of the "Scoopeeze"© device.

The inner semi-circle insert 106 is made of polypropylene, plastic or composite or other synthetic material. The size and arc conform to the inner diameter and width of the outer semi-circular frame 104. The inner semi-circle insert 106 covers 180 degrees. In addition, the inner semi-circle insert 106 is closed on both ends. One of the ends has an elliptically shaped protrusion 112, or tab which facilitates the manual rotation of the inner semi-circle insert.

The leading edge 114 of the inner semi-circle insert 106 is beveled to create a thin scooping edge to easily lift and move under the waste material. A groove 116 is located in the outer circumference of the leading and trailing edges of the inner semi-circle insert 106 to facilitate the positive connection of the liner 108.

The liner 108 is a thin semi ridged plastic, composite, synthetic or organic biodegradable material that has the same general shape as the inner-semi circle insert 106 and conforms to the contour of the inner circumference of the inner semi-circle insert 106. The liner 108 has a lip 118 on all four edges that wraps and covers the edges of the inner semi-circle insert 106. The liner 108 snaps into place by way of a slight groove 116 located in the outer circumference of the leading and trailing edges of the inner semi-circle insert 106.

Attached to the trailing edge of the liner 120 is a very thin very flexible sheet of bio-degradable plastic, composite, synthetic, or organic material which when the inner semi-circle insert is turned, forms a cover over the open area of the inner semi-circle insert 106 and liner 108 and encloses the waste material as the inner semi-circle insert 106 is turned. The leading edge of the liner is coated with a light adhesive that comes into contact with the flexible sheet as the inner semi circle 106 is rotated. This thin plastic sheet also keeps waste material from coming into contact with the outer semi-circular frame 104, and the inner semi-circle insert 106.

The detachable handle, outer semi-circle, inner semi-circle insert and inner semi-circle insert liners will be available in many colors.

Operation: two methods of operation: If the waste material is contained in a "pile" the waste pickup device 100 with a liner 108 in position is placed over the waste material with the inner semi-circle insert 106 in the up position or ready position within the outer semi-circular frame 104. The thin flexible sheet material 120 trailing from the liner 108 is positioned to the rear of the outer semi-circle. This allows the open area of the outer semi-circular frame 104 to pass over the waste material. When the outer semi-circular frame 104 is touching the ground the pet owner manually rotates the tab on the sidewall of the inner semi-circle insert 106 in a clockwise direction.

As the front edge of the inner semi-circle insert 106 scoops under the waste material the flexible sheet material begins to seal the waste material within the liner 108 in the inner semi-circle insert 106. When the inner semi-circle insert 106 has been rotated 180 degrees the waste is contained and sealed within the inner semi-circle insert 106. The waste pickup device 100 will carry the waste material discretely sealed until a suitable trash or waste receptacle is reached. Then the inner semi-circle insert 106 is manually slid laterally out of the outer semi-circular frame 104 and the liner containing the waste material is disposed of. A new liner 108 is placed into the semi-circle insert 106, and the inner semi-circle insert 106 and liner 108 are then placed into the outer semi-circular frame 104. The waste pickup device 100 is now ready for another use.

The second method of operation is like the first except for the following: If the waste material is not piled, but rather, spread out in a random fashion, the inner semi-circle insert 106 and liner 108 are removed from the outer semi-circular frame 104. The pet owner uses the inner semi-circle insert 106 and liner 108 to move the waste material into a pile. The inner semi-circle insert 106 is then laid concave side down over the waste with the flexible sheet material component 120 of the liner 108 to the rear and flat on the ground. The waste pickup device 100 outer semi-circular frame 104 is then brought in behind the inner semi-circle insert 106. The pet owner slightly lifts the rear of the inner semi-circle insert 106 and as the outer semi-circular frame 104 is slid under the inner semi-circle insert 106, then rotates clockwise the protruding tab 112 on the inner semi-circle insert 106. As the inner semi-circle insert 106 is rotated it starts to seal the liner 108 and when the inner semi-circle insert 106 has rotated 180 degrees the waste is sealed in the disposable liner 108 and the inner semi-circle insert 106 is back in the outer semi-circular frame 104. The waste is discretely sealed and ready to be disposed of property.

Left or Right hand operation: By placing the elliptical protrusion or tab on the inner semi-circle insert on the right hand side of the outer semi-circle, the "Scoopeeze"© is ergonomically designed for a right-handed person. For left-handed people the inner semi-circle insert is loaded so the protrusion or tab is on the left side of the outer semi-circle.

Configurations: Using "Scoopeeze"© with retractable or standard leashes, Configuration one: Attached to a pre-existing retractable leash: With the "Scoopeeze"© detachable handle removed, the top area of the outer semi-circle has a molded docking area which allows the lower portion of any 3$^{rd}$ party retractable leash to be connected to the "Scoopeeze"© device. Connections between the "Scoopeeze"© and the retractable leash are made by industrial strength Velcro strips placed within the contours of the outer surfaces of the "Scoopeeze"© docking area and the lower portion of the retractable leash. The converging angles of the docking area also squeeze the retractable leash as it is placed into the Scoopeeze© dock.

Configuration Two: Attached to a traditional leather, nylon or other material leash. In this configuration, the Detachable handle is docked to the outer semi-circle. The eyelet at the front end of the Detachable handle holds a metal ring. The metal ring is used to connect to the handle part of a standard leash to the Detachable handle. This configuration provides a more ergonomic handle by which to control the pet and when docked with Scoopeeze© operates as described above.

Scoopeeze is unique in that prior technology in this field fails to address one or more of the following problems. Time, touch, portability, esthetics.

The simplest form of waste pick up while walking a dog is to invert a plastic bag over ones hand and pick up the waste while using the other hand to pull bag to cover waste. Some devices have been manufactured to dispense the plastic bags and attach to a common leash. Other products have been designed to facilitate pushing the waste into a manufactured opening attached to a plastic bag or into a cardboard container. One or more of these problems exist with these technologies: they take to much time to prepare, the pet owner is obliged to grasp the waste material, the waste material once contained must be carried in ones free hand, or encumber the leash hand. Further, Scoopeeze© in very efficient with resources as it uses a minimum of disposable material whereas other products tend to be completely disposable Scoopeeze addresses all of the above problems in that it's preparation for use and time to pick up waste material is extremely short, the pet owner never has to use their hands to grasp the waste material, the waste container is neatly contained within the Scoopeeze housing so it is out of sight, the Scoopeeze device is integrated into the leash system so the waste is not carried by the free hand nor is it carried separately by the leash hand.

The device efficiently uses material resources, and the contours and vibrant colors of this device make it an esthetically pleasing addition to dog walking equipment.

What is claimed is:

1. A device for collecting, transporting, and disposing of waste material comprising:

a handle; and a body coupled to said handle and further comprising:

an outer semi-circular frame having an inner cavity;

a semi-circular insert inserted into said outer semi-circular frame; and a liner inserted into said semi-circular insert, wherein said inner semi-circular insert rotates within said inner cavity of said outer semi-circular frame and said semi-circular insert further comprises a graspable protrusion coupled to a lateral surface of said semi-circular insert.

2. The device of claim 1, wherein said handle, said outer semi-circular frame, said semi-circular insert and said liner are composed of a synthetic or an organic substance.

3. The device of claim 1, wherein said semi-circular insert comprises at least one beveled edge.

4. The device of claim 1, wherein said handle comprises an eyelet suitable for insertion therethrough of a metal ring.

5. The device of claim 1, w herein said outer semi-circular frame comprises a docking area suitable for providing attachment of a retractable leash or said handle.

6. The device of claim 1, wherein said semi-circular insert is suitable for insertion into said outer semi-circular frame to provide a right handed configuration or a left handed configuration.

7. The device of claim 1, wherein said semi-circular insert is removable from said outer semi-circular frame to arrange waste material, and reinsertable into said outer semi-circle to collect waste material.

8. The device of claim 1, wherein said liner further comprises a lip suitable for folding over and covering a portion of said semi-circular insert.

9. A device for collecting, transporting, and disposing of waste comprising:

a handle;

a substantially semi-circular outer body coupled to said handle further comprising an outer body inner circumference and an outer surface having an upper region;

an insert inserted into said substantially semi-circular outer body, said insert further comprising an insert inner circumference; and a linear for lining said insert inner circumference further comprising a leading edge and a trailing edge, wherein said insert rotates within said outer body inner circumference, and said semi-circular insert comprises a ridge along a topmost inner section of at least two semi-circular insert lateral edges.

10. The device of claim 9, wherein said handle further comprises an eyelet suitable for receiving a leash attachment assembly.

11. The device of claim 9, wherein said upper region of said substantially circular outer body further comprises a docking region suitable for docking said handle or a retractable leash.

12. A device for collecting, transporting, and disposing of waste material comprising:

a handle; and a body coupled to the handle and further comprising:

an outer semi-circular frame having an inner cavity;

a semi-circular insert inserted into said outer semi-circular frame; and a liner inserted into said semi-circular insert further comprising at least one edge coated with an adhesive substance, wherein said inner semi-circular insert rotates within said inner cavity of said outer semi-circular frame.

13. The device of claim 12, wherein a flexible sheet is coupled to said liner.

14. The device of claim 13, wherein said flexible sheet comprises a living hinge and is suitable for covering said waste material as said semi-circular insert is rotated.

* * * * *